US012740643B2

(12) United States Patent
Huang

(10) Patent No.: US 12,740,643 B2
(45) Date of Patent: Sep. 22, 2026

(54) ANTI-COLLISION STRIP AND BUNDLE ROLL THEREOF

(71) Applicant: MAYAPPLE BABY LLC, Brooklyn, NY (US)

(72) Inventor: Jianying Huang, Brooklyn, NY (US)

(73) Assignee: MAYAPPLE BABY LLC, Brooklyn, NY (US)

( * ) Notice: Subject to any disclaimer, the term of this patent is extended or adjusted under 35 U.S.C. 154(b) by 443 days.

(21) Appl. No.: 18/370,991

(22) Filed: Sep. 21, 2023

(65) Prior Publication Data

US 2025/0040704 A1 Feb. 6, 2025

(30) Foreign Application Priority Data

Aug. 1, 2023 (CN) ..... 202322053582.7

(51) Int. Cl.
*A47B 95/04* (2006.01)

(52) U.S. Cl.
CPC ..... *A47B 95/043* (2013.01)

(58) Field of Classification Search
CPC ..... A47B 95/043; A47B 95/046
USPC ..... 114/219; 248/345.1; 267/139, 140, 152, 267/153; 293/102, 120
See application file for complete search history.

(56) References Cited

U.S. PATENT DOCUMENTS 1,390,370 A * 9/1921 Mester ..... A47B 95/04 248/345.1
1,491,231 A * 4/1924 Handsel ..... B60R 19/32 293/137
1,566,839 A * 12/1925 Denels ..... B60R 19/18 293/120
1,612,948 A * 1/1927 Shaw ..... B60R 19/18 293/120
1,936,113 A * 11/1933 Jelliffe ..... A47B 13/083 15/325
3,669,490 A * 6/1972 Bertolet ..... A47C 3/029 248/345.1
4,433,834 A * 2/1984 Jwuc ..... B60G 11/22 267/141.1
4,999,227 A * 3/1991 Vander Togt ..... B32B 27/08 428/319.7
5,496,609 A * 3/1996 Michelstein ..... A47B 95/043 52/287.1

* cited by examiner

*Primary Examiner* — Christopher P Schwartz
(74) *Attorney, Agent, or Firm* — FBT Gibbons LLP

(57) ABSTRACT

An anti-collision strip includes a first side edge mounting portion, an intermediate portion, and a second side edge mounting portion connected in sequence along a width direction of the anti-collision strip. The first side edge mounting portion, the intermediate portion and the second side edge mounting portion extend along a length direction of the anti-collision strip. A first inner side groove and a second inner side groove extend along the length direction of the anti-collision strip and provide buffer space. The anti-collision strip can be stably and reliably adhered on corners having various angles to provide protection, can avoid peeling due to rebound force, and has a good protection effect on the edges of the corners, thereby improving the convenience of use.

10 Claims, 6 Drawing Sheets

ANTI-COLLISION STRIP AND BUNDLE ROLL THEREOF

FIELD

The present application relates to the technical field of anti-collision strips, and in particular to an anti-collision strip and a bundle roll of anti-collision strip.

BACKGROUND

In daily life, there are various types of corners, such as corners of various types of furniture in the home, corners of stairs, corners of handrails, corners of amusement facilities in children's amusement parks. Children often collide with the edges of such corners due to the restless nature, therefore these edges pose a potential risk to children, such as abrasions and bruises, etc. In addition, the corners of some articles to be protected are exposed to the potential risk of bump and being damaged. As people's safety awareness increases, people often wrap these corners with various anti-collision strips to reduce such potential risk.

At present, the common anti-collision strips on the market are right-angle anti-collision strips and planar anti-collision strips. For the right-angle anti-collision strips, in use, the user needs to apply a double-sided tape on both sides of the corner and then place the right-angle anti-collision strip on the corner and press to fit closely with the double-sided tape, so as to adhere the right-angle anti-collision strip to the corner. However, a long time is needed for the user to apply double-sided tape to both sides. In addition, the right-angle anti-collision strips usually fall off over a period of time, thereby reducing the experience of the user. For example, a right-angle anti-collision strips is generally adapted to a right-angle corner, but is not suitable for corners less than 90° or greater than 90°. For example, for a corner less than 90°, two side edge portions of the right-angle anti-collision strip need to be pressed to adhere to the surface of the corner. However, due to the resilience of the two side edge portions of the right-angle anti-collision strip, over a period of time, the two side edge portions of the right-angle anti-collision strip will peel or detach from the surface of the corner.

For the planar anti-collision strips, in order to be folded and adhered to the corners expediently, a plurality of grooves spaced along the width direction thereof and extending in the length direction thereof are generally formed on the outer side surface of the planar anti-collision strips. In use, the user would also need to apply a double-sided tape to both sides of the corner, then apply the planar anti-collision strip to one side first, and then fold the planar anti-collision strip over to apply to the other side. However, the aesthetic appearance is reduced by the plurality of grooves, and the thickness of the planar anti-collision strip at the grooves is thin, and in some cases, the edges of the corners align at and abut against the grooves of the planar anti-collision strips which are thin during adhesion, thereby reducing the protective effect. In addition, such planar anti-collision strips also curl and fall off over a period of time, thereby reducing the experience of the user.

SUMMARY

In a first aspect, the object of the present invention is to provide an anti-collision strip. The anti-collision strip can be stably and reliably adhered on corners having various angles to provide excellent protection, can avoid peeling due to resilience, and has a good protection effect on the edges of the corners, thereby improving the convenience of use.

In order to achieve the above-mentioned object, the present invention provides an anti-collision strip comprising a first side edge mounting portion, an intermediate portion and a second side edge mounting portion connected in sequence along a width direction of the anti-collision strip, the first side edge mounting portion, the intermediate portion and the second side edge mounting portion extending along a length direction of the anti-collision strip, wherein a first inner side groove extending along the length direction of the anti-collision strip is formed at a junction of a first inner side surface of the first side edge mounting portion and an intermediate inner side surface of the intermediate portion, a second inner side groove extending along the length direction of the anti-collision strip is formed at a junction of a second inner side surface of the second side edge mounting portion and the intermediate inner side surface of the intermediate portion.

In this technical solution, the first inner side groove extending along the length direction of the anti-collision strip is formed at the junction of the first inner side surface and the intermediate inner side surface, and the second inner side groove extending along the length direction of the anti-collision strip is formed at the junction of the second inner side surface and the intermediate inner side surface, the first inner side groove and the second inner side groove can provide an effective buffer space to avoid squeezing the junction between the first side edge mounting portion and the intermediate portion and the junction between the second side edge mounting portion and the intermediate portion, so as to reduce the resilience of the anti-collision strip, and to allow the first side edge mounting portion and the second side edge mounting portion to have a larger turn-out space with respect to the intermediate portion. For example, when the angle of the corner is smaller than the angle between the first inner side surface and the second inner side surface of the anti-collision strip, the buffer space provided by the first inner side groove and the second inner side groove can prevent the juncture between the first side edge mounting portion and the intermediate portion and the juncture between the second side edge mounting portion and the intermediate portion from being squeezed, to reduce the resilience of the anti-collision strip, thereby reducing or avoiding the possibility of peeling of the anti-collision strip due to excessive resilience in the mounted state, particularly in the 90° mounted state. When the angle of the corner is larger than the angle between the first inner side surface and the second inner side surface of the anti-collision strip, the buffer space provided by the first inner side groove and the second inner side groove may allow the first side edge mounting portion and the second side edge mounting portion to have a larger turn-out space with respect to the intermediate portion, to avoid tearing the junction between the first side edge mounting portion and the intermediate portion, and the junction between the second side edge mounting portion and the intermediate portion, and to allow the anti-collision strip to be adhered more closely to the corner. Therefore, the anti-collision strip can be stably and reliably adhered on corners to avoid peeling due to resilience, and has a good protective effect on the edge of the corner, thereby improving the convenience of use.

Furthermore, in some embodiments, due to the presence of the first and second inner side grooves, it is possible to avoid the formation of a plurality of grooves as in the prior art on the intermediate portion, which ensures the thickness of the intermediate portion, such that the anti-collision strip only needs to be wrapped around the edges of the corners during installation. In addition, due to the presence of the first and second inner side grooves, not only can the anti-collision strip be suitable for corner protection of various angles, but also the user can easily break the first side edge mounting portion and the second side edge mounting portion to both sides, thereby facilitating the adhesion of the double-sided tape to the first inner side surface and the second inner side surface, and improving the convenience of use. Therefore, the anti-collision strip can be stably and reliably adhered to the corner to avoid peeling due to the rebound force, and has a further excellent protective effect against the edge of the corner.

In some embodiments, in a natural state of the anti-collision strip, an angle A between the first inner side surface and the second inner side surface satisfies: 90°≤angle A≤180°.

In some embodiments, in the natural state of the anti-collision strip, the angle A between the first inner side surface and the second inner side surface is greater than 90°.

In some embodiments, in the natural state of the anti-collision strip, the angle A between the first inner side surface and the second inner side surface is equal to or greater than 135°.

In some embodiments, in the natural state of the anti-collision strip, the angle A between the first inner side surface and the second inner side surface is equal to 180°.

In some embodiments, the first inner side groove and the second inner side groove have a depth of 0.2 cm to 0.4 cm.

In some embodiments, the cross-sectional shape of the first and second inner side grooves includes a V-shape, a U-shape, or a semicircular shape.

In some embodiments, an adhesive layer with a tearable protective film is formed on the first inner side surface and the second inner side surface.

In some embodiments, a first outer side groove extending along the length direction of the anti-collision strip is formed at a junction of a first outer side surface of the first side edge mounting portion and an intermediate outer side surface of the intermediate portion, a second outer side groove extending along the length direction of the anti-collision strip is formed at a junction of a second outer side surface of the second side edge mounting portion and the intermediate outer side surface of the intermediate portion.

In some embodiments, the first inner side groove and the first outer side groove are staggered in a width direction of the anti-collision strip, and the second inner side groove and the second outer side groove are staggered in the width direction of the anti-collision strip, such that the distance between the first outer side groove and the second outer side groove is greater than the distance between the first inner side groove and the second inner side groove.

In some embodiments, a distance in the thickness direction of the anti-collision strip between a groove bottom of the first inner side groove and a groove bottom of the first outer side groove is greater than 0.5 cm.

In some embodiments, the first outer side groove and the second outer side groove have a depth of 0.1 cm to 0.3 cm.

In some embodiments, the cross-sectional shape of the first outer side groove and the second outer side groove comprises a V-shape, a U-shape, or a semicircular shape.

In some embodiments, the thickness of the intermediate portion is greater than the thickness of the first side edge mounting portion and the second side edge mounting portion.

In some embodiments, the intermediate inner side surface is a concave arc-shaped surface.

In some embodiments, the thickness of the intermediate portion at the lowest point of the concave arc-shaped surface is greater than the thickness of the first side edge mounting portion and the second side edge mounting portion.

In some embodiments, the width distance between the two side edges of the intermediate inner side surface in the width direction of the anti-collision strip is between 0.6 cm and 1.2 cm.

In some embodiments, in the natural state of the anti-collision strip, the intermediate outer side surface of the intermediate portion is a flat surface or a convex arc-shaped surface.

In some embodiments, along the direction from the intermediate portion to each side edge, the first outer side surface of the first side edge mounting portion is obliquely arranged so that the first side edge mounting portion has a gradually decreased thickness, and the second outer side surface of the second side edge mounting portion is obliquely arranged so that the thickness of the second side edge mounting portion has a gradually decreased thickness.

In some embodiments, the width of the first inner side surface and the second inner side surface is between 2.5 cm and 3.5 cm.

In some embodiments, at least one of the first side edge mounting portion and the second side edge mounting portion has at least one cutting track extending along the length direction of the anti-collision strip, the cutting track being configured to allow a user to cut along the length direction of the anti-collision strip to reduce the width of the corresponding side edge mounting portion.

In a second aspect, the object of the present invention is to provide a bundle roll of anti-collision strip, wherein the bundle roll comprises at least one anti-collision strip of any one of the above first aspect, wherein at least one of the anti-collision strip is wound into a bundle roll with its inner side surface facing outwards.

BRIEF DESCRIPTION OF THE DRAWINGS

For a better understanding of the above and other objects, features, advantages and functions of the present invention, reference may be made to the preferred embodiments as illustrated in the accompanying drawings. The same or similar reference numbers throughout the drawings refer to the same or like parts. It should be understood by those skilled in the art that the drawings are intended to schematically illustrate preferred embodiments of the present invention and do not limit the scope of the present invention, and that the various elements in the drawings are not necessarily drawn to scale.

DESCRIPTION OF REFERENCE NUMERALS

Figure 1:
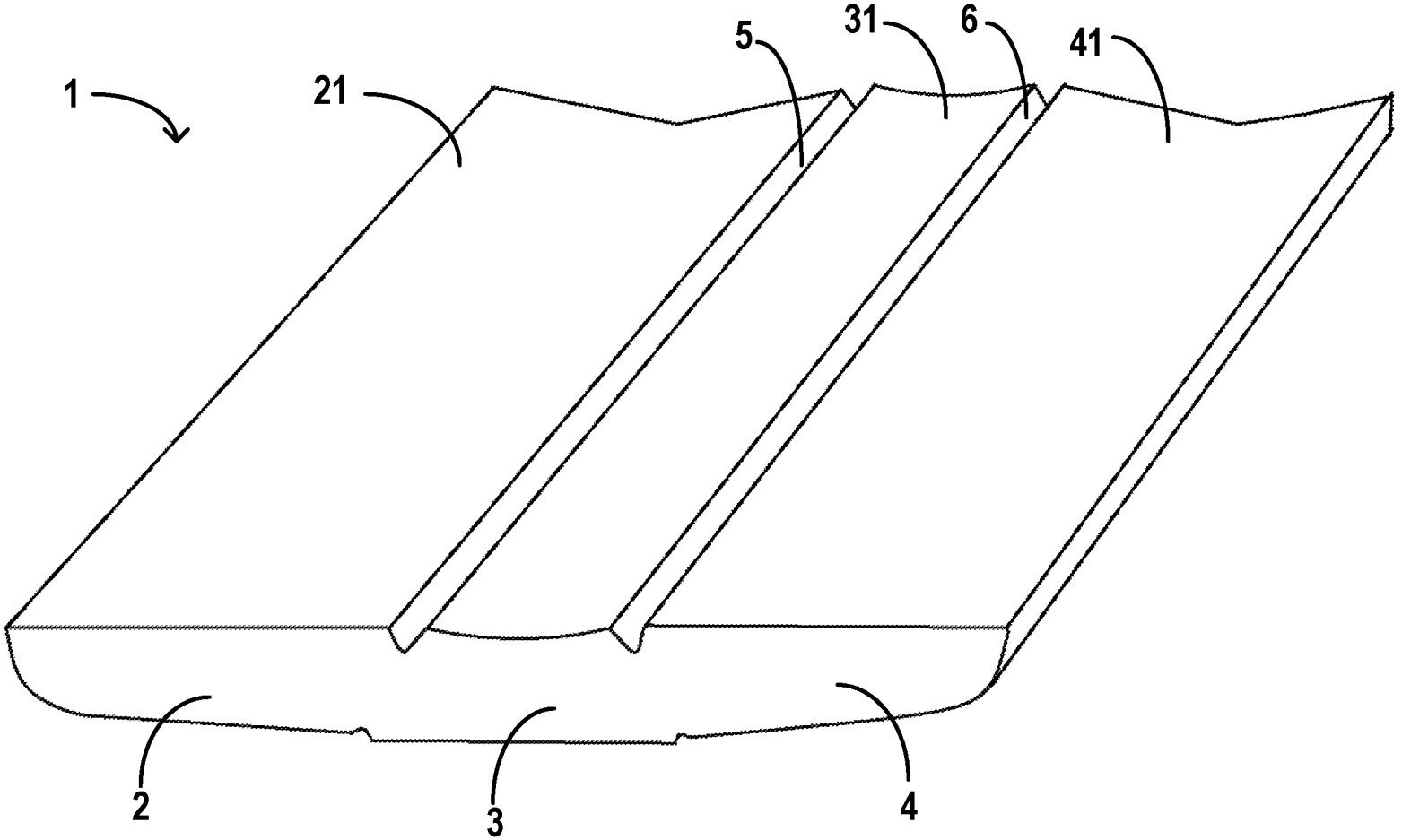
FIG. 1 is a perspective view of a section of an anti-collision strip provided by an embodiment of the present invention.

1—anti-collision strip, 2—first side edge mounting portion, 3—intermediate portion, 4—second side edge mounting portion, 5—first inner side groove, 6—second inner side groove, 7—first outer side groove, 8—second outer side groove, 9—concave arc-shaped surface, 10—adhesive layer, 21—first inner side surface, 22—first outer side surface, 31—intermediate inner side surface, 32—intermediate outer side surface, 41—second inner side surface, 42—second outer side surface.

DETAILED DESCRIPTION

In the following detailed description of the embodiments, reference is made to the accompanying drawings that form a part hereof. The drawings show, by way of example, specific embodiments in which the invention is embodied. The embodiments shown are not intended to be exhaustive of all embodiments according to the invention. It is to be understood that other embodiments may be utilized and structural or logical changes may be made without departing from the scope of the present invention. With respect to the figures, directional terms, such as "lower", "upper", "left", "right", and the like, are used with reference to the orientation of the figure being described. Since the components of embodiments of the present invention can be implemented in a variety of orientations, these directional terms are used for purposes of illustration and not for purposes of limitation. Therefore, the following detailed description of the embodiments is not to be taken in a limiting sense, and the scope of the present invention is defined by the appended claims.

In a first aspect, with reference to FIGS. 1, 2, 3, 4 and 5, an anti-collision strip 1 provided by an embodiment of the present invention comprises a first side edge mounting portion 2, an intermediate portion 3 and a second side edge mounting portion 4 connected in sequence along a width direction of the anti-collision strip 1, and the first side edge mounting portion 2, the intermediate portion 3 and the second side edge mounting portion 4 extend along a length direction of the anti-collision strip 1, wherein a first inner side groove 5 extending along the length direction of the anti-collision strip is formed at a junction of a first inner side surface 21 of the first side edge mounting portion 2 and an intermediate inner side surface 31 of the intermediate portion 3, and a second inner side groove 6 extending along the length direction of the anti-collision strip is formed at a junction of a second inner side surface 41 of the second side edge mounting portion 4 and the intermediate inner side surface 31 of the intermediate portion 3.

In the anti-collision strip 1, as the first inner side groove 5 extending along the length direction of the anti-collision strip 1 is formed at the junction of the first inner side surface 21 and the intermediate inner side surface 31, and the second inner side groove 6 extending along the length direction of the anti-collision strip 1 is formed at the junction of the second inner side surface 41 and the intermediate inner side surface 31, the first inner side groove 5 and the second inner side groove 6 can provide effective buffer space to avoid squeezing the junction between the first side edge mounting portion 2 and the intermediate portion 3 and the junction between the second side edge mounting portion 4 and the intermediate portion 3, so as to reduce the resilience of the anti-collision strip 1, and to allow the first side edge mounting portion 2 and the second side edge mounting portion 4 to have a larger space for being turned-out with respect to the intermediate portion 3. For example, when the corner has an angle smaller than the angle A between the first inner side surface and the second inner side surface of the anti-collision strip, the buffer space provided by the first inner side groove 5 and the second inner side groove 6 can prevent the junction between the first side edge mounting portion 2 and the intermediate portion 3 and the junction between the second side edge mounting portion 4 and the intermediate portion 3 from being squeezed, so as to reduce the resilience of the anti-collision strip, thereby reducing or avoiding the possibility of peeling of the anti-collision strip due to excessive resilience in the mounted state, particularly in the 90° mounted state. When the corner has an angle larger than the angle A between the first inner side surface 21 and the second inner side surface 31 of the anti-collision strip, the buffer space provided by the first inner side groove 5 and the second inner side groove 6 may allow the first side edge mounting portion 2 and the second side edge mounting portion 4 to have a larger space for being turned-out with respect to the intermediate portion 3, so as to avoid tearing the junction between the first side edge mounting portion 2 and the intermediate portion 3, and the junction between the second side edge mounting portion 4 and the intermediate portion 3, and to allow the anti-collision strip to be adhered more closely to the corner. Therefore, the anti-collision strip can be stably and reliably adhered on corners, and peeling due to resilience can be avoided, which has a good protective effect for the edge of the corner and improves the convenience of use.

Furthermore, in some embodiments, the intermediate portion 3 of the anti-collision strip 1 of the present invention may be formed with a plurality of grooves arranged at intervals in the width direction of the anti-collision strip 1 and extending along the length direction of the anti-collision strip 1.

Furthermore, in some embodiments, due to the presence of the first and second inner side grooves 5 and 6, it is possible to avoid the formation of a plurality of grooves as in the prior art on the intermediate portion 3, which ensures the sufficient thickness of the intermediate portion 3, that is, local part in the intermediate portion which has too thin thickness can be avoided, such that the anti-collision strip 1 only needs to be wrapped around the edges of the corners during installation. In addition, due to the presence of the first and second inner side grooves 5 and 6, not only can the anti-collision strip be suitable for corner protection of various angles, but also the user can easily break the first side edge mounting portion 2 and the second side edge mounting portion 4 to both sides, thereby facilitating the adhesion of the double-sided tape to the first inner side surface 21 and the second inner side surface 41, and improving the convenience of use. Therefore, the anti-collision strip 1 can be stably and reliably adhered to the corner, and peeling due to the resilience can be avoided, which has a further excellent protective effect for the edge of the corner, and improves the convenience of use.

In addition, in the anti-collision strip 1 of the present invention, the overall thickness of the anti-collision strip 1 can be flexibly adjusted according to practical requirements, that is to say, the overall thickness of the anti-collision strip 1 can be increased or decreased, as long as the required thickness of the intermediate portion 3 is ensured and the local part in the intermediate portion 3 which has too thin thickness is avoided. For example, in some embodiments, the intermediate portion 3 is formed with a plurality of grooves arranged at intervals in the width direction thereof and extending along the length direction thereof, but the thickness of the intermediate portion 3 at the grooves also satisfies the desired thickness.

In the anti-collision strip 1 of the present invention, in the natural state of the anti-collision strip, the angle A between the first inner side surface 21 and the second inner side surface 41 may be any appropriate angel value. For example, it may be less than 90°, equal to 90° or greater than 90°.

For example, in some embodiments, the angle A between the first inner side surface 21 and the second inner side surface 41 satisfies: 90°≤angle A≤180°. For example, in embodiments where the angle A is any value greater than 90°, the anti-collision strip may be further adapted for corner protection at various angles. For example, in some embodiments, the angle A between the first inner side surface 21 and the second inner side surface 41 is greater than 135°, which may further facilitate the application of double-sided tape to the first inner side surface 21 and the second inner side surface 41, and especially facilitate the automatic pre-application of double-sided tape to the first inner side surface 21 and the second inner side surface 41 by a machine, thereby improving the production efficiency, ensuring the consistency of double-sided tape application, and reducing the cost and quality defects of manual application.

Figure 2:
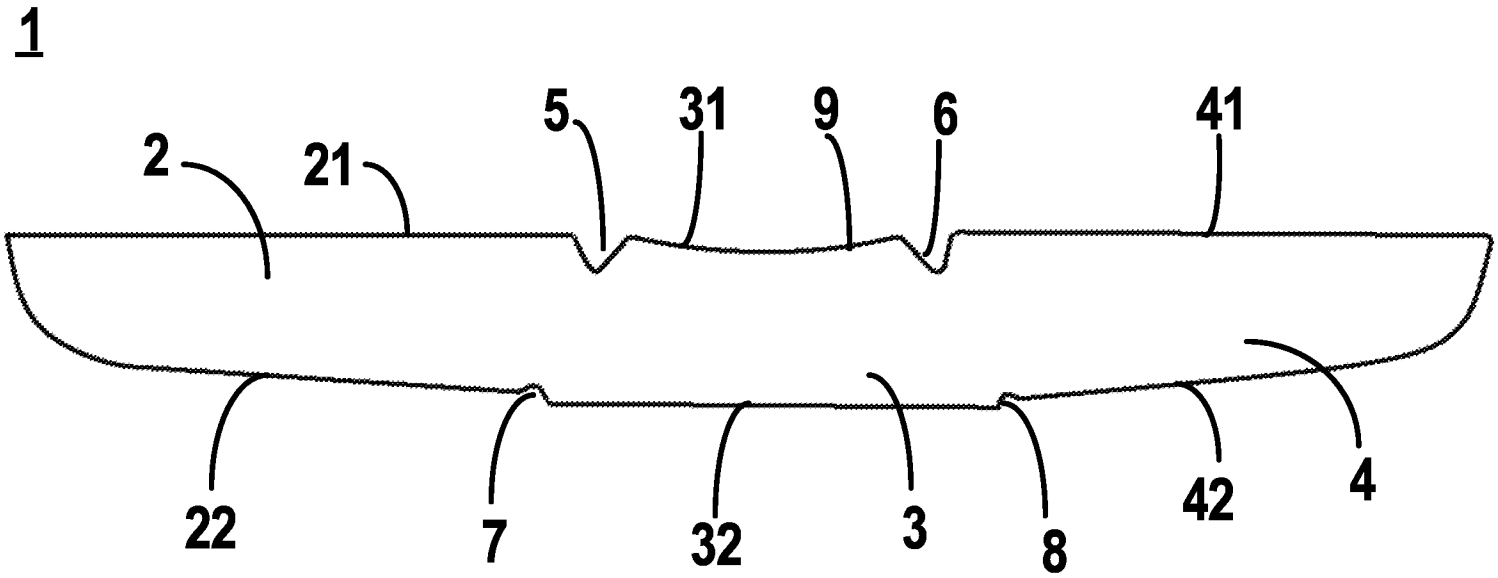
FIG. 2 is a schematic view of an end portion structure of a section of the anti-collision strip of FIG. 1.
Figure 3:
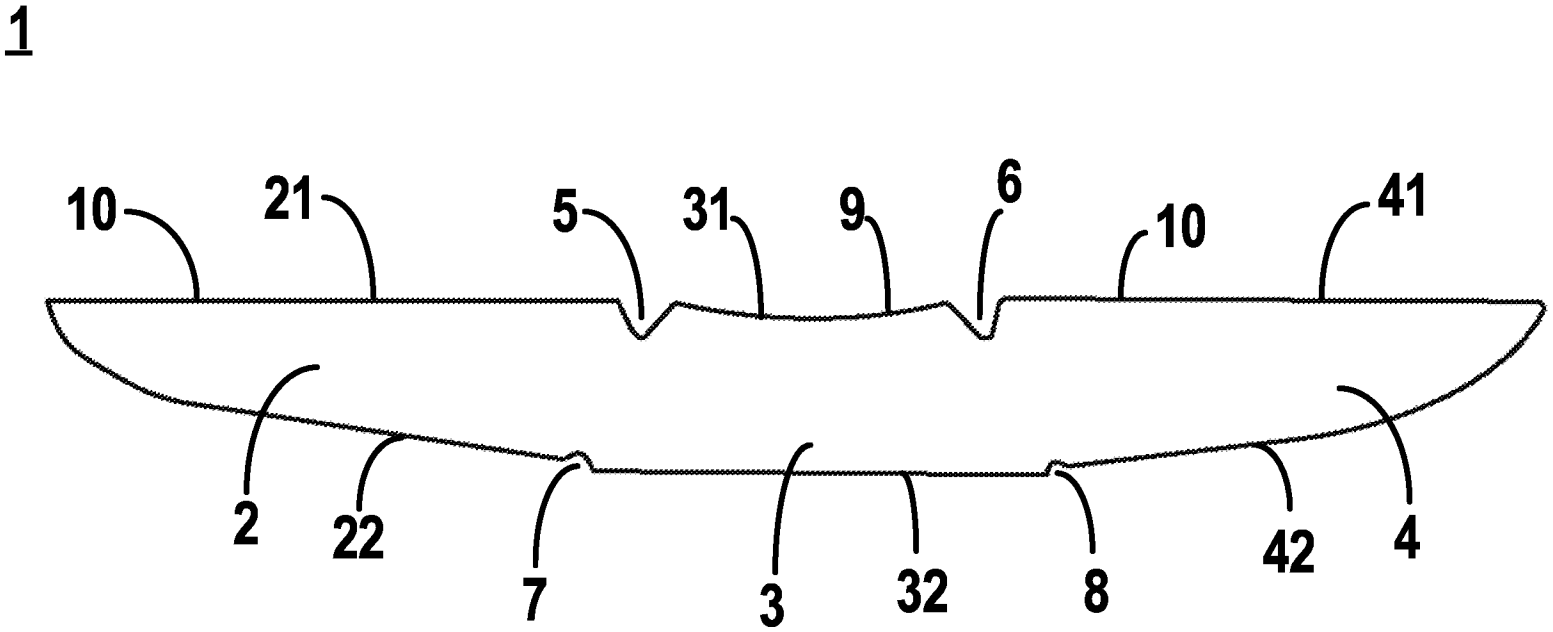
FIG. 3 is a schematic view of an end portion structure of another anti-collision strip provided by an embodiment of the present invention.
Figure 4:
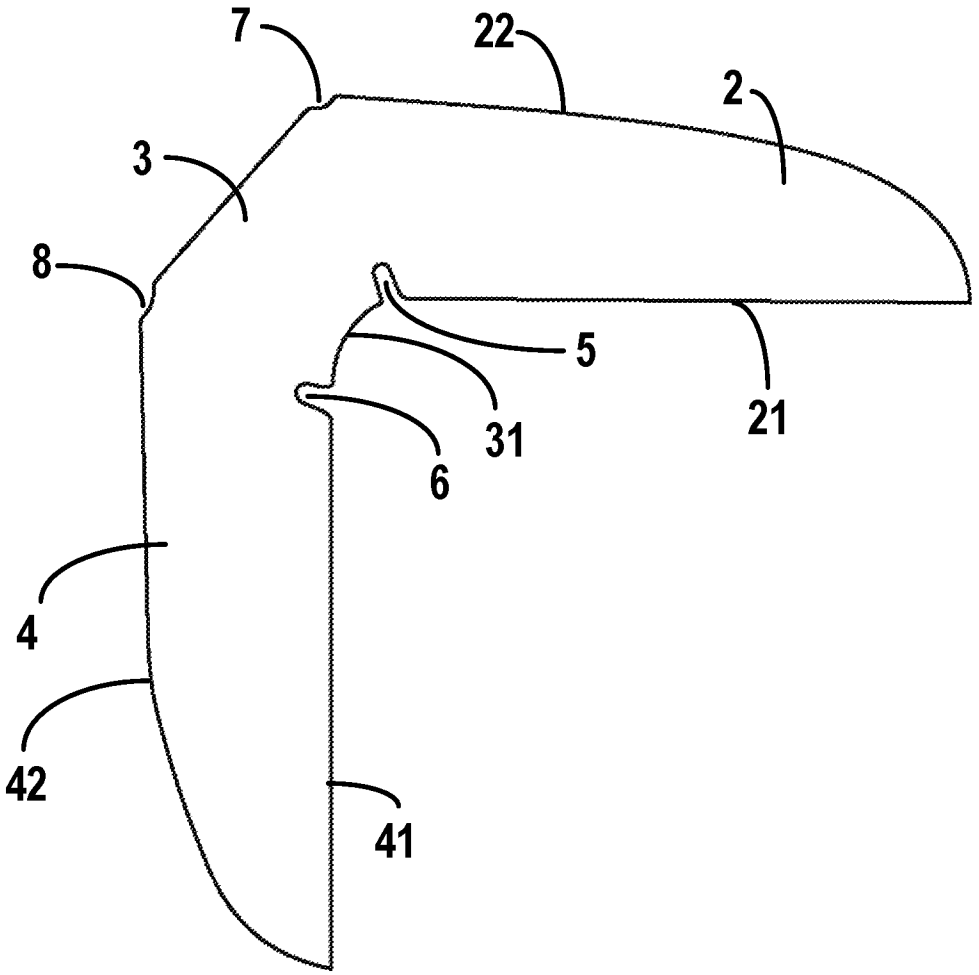
FIG. 4 is a schematic view of an anti-collision strip in a 90° mounted state provided by an embodiment of the present invention.
Figure 5:
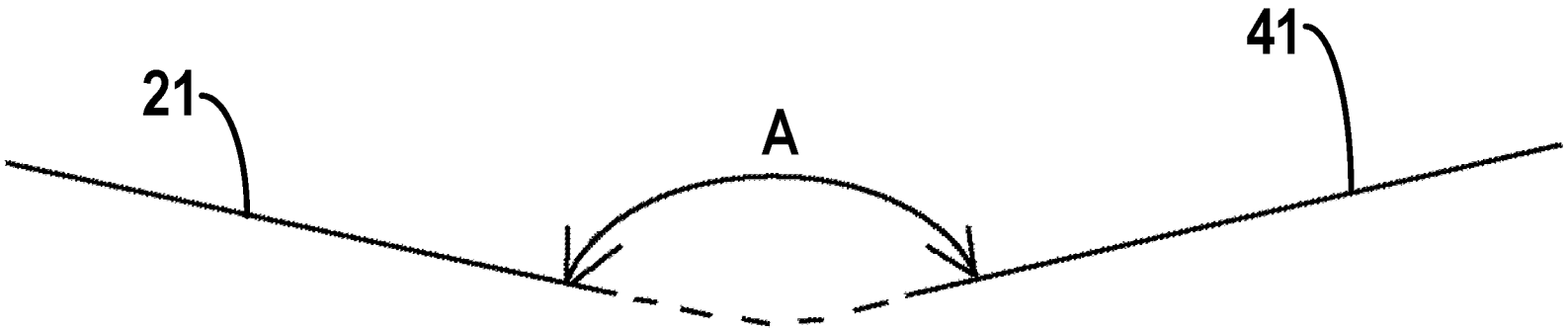
FIG. 5 is a schematic view of an angle A between a first inner side surface and a second inner side surface of an anti-collision strip provided by an embodiment of the present invention.

Furthermore, in some embodiments, referring to FIGS. 1, 2 and 3, the angle A between the first inner side surface 21 and the second inner side surface 41 is equal to 180°, that is, the anti-collision strip 1 is formed as a planar anti-collision strip. In this way, since the first inner side surface 21 and the second inner side surface 41 are arranged in a plane in a natural state of the anti-collision strip, it is easy to adhere the double-sided tape to the first inner side surface 21 and the second inner side surface 41, and in particular, it is further convenient for the machine to automatically pre-adhere the double-sided tape to the first inner side surface 21 and the second inner side surface 41, and in addition, it is also convenient to naturally bundling the anti-collision strip to reduce a storage space and to facilitate package transportation.

In addition, it needs to be stated here that the anti-collision strip 1 of the present invention do not have to be packed, stored and transported in a rolled manner. For example, in some embodiments, the anti-collision strip 1 may also have a preset length and be stored, packaged, and transported in a naturally spread manner.

Further, the angle A between the first inner side surface 21 and the second inner side surface 41 in the mounted state of the anti-collision strip may be any suitable angle value from 0° to 180°. For example, for very thin flat edges (e.g. flat edges of glass or steel plate), the first inner side surface 21 and the second inner side surface 41 of the anti-collision strip are parallel to each other in the mounted state, in which case the angle A between the first inner side surface 21 and the second inner side surface 41 may be 0°. As another example, when the anti-collision strip is installed flat on a plane to be protected, the first inner side surface 21 and the second inner side surface 41 of the anti-collision strip will be located on the same plane, in which case the angle A between the first inner side surface 21 and the second inner side surface 41 may be 180°. As another example, for a 90° edge, the angle A between the first inner side surface 21 and the second inner side surface 41 may be 90° in the mounted state. As another example, for edges less than 90°, the angle A between the first inner side surface 21 and the second inner side surface 41 may be an acute angel (e.g. 30°. 45°, or 60°) in the mounted state. As another example, for edges greater than 90°, the angle A between the first inner side surface 21 and the second inner side surface 41 may be an obtuse angle (e.g. 120°. 135°, or 150°) in the mounted state.

In addition, in the anti-collision strip 1 of the present invention, the first inner side groove 5 and the second inner side groove 6 may have any desired depth, that is, the distance from an opening portion of the groove to a bottom thereof, for example, in some embodiments, the depth of the first inner side groove 5 and the second inner side groove 6 is 0.2 cm-0.4 cm. In some embodiments, the first inner side groove 5 and the second inner side groove 6 have a depth of 0.3 cm. Further, the first inner side groove 5 and the second inner side groove 6 may have the same depth or may have different depths.

Furthermore, in the anti-collision strip 1 of the present invention, the cross-sectional shapes of the first inner side groove 5 and the second inner side groove 6 may have any desired shape, for example, in some embodiments, the cross-sectional shapes of the first inner side groove 5 and the second inner side groove 6 include a V-shape (e.g. the V-shape shown in FIGS. 2 and 3), a U-shape, or a semicircular shape. The V-shape. U-shape or semicircular shape not only facilitates shaping, but also forms an arc-shaped transition at the bottom of the groove, which avoids tearing the anti-collision strip at the first inner side groove 5 and the second inner side groove 6. Of course, the cross-sectional shapes of the first inner side groove 5 and the second inner side groove 6 are not limited thereto, and may be rectangular, trapezoidal, or other shapes.

In addition, in some embodiments of the anti-collision strip of the present invention, the anti-collision strip is not previously adhered with double-sided tape, and the anti-collision strip without double-sided tape can be used as a finished product or a semi-finished product; after being purchased by a user, the double-sided tape can be adhered on the first inner side surface 21 and the second inner side surface 41 by the user, or after being purchased by other manufacturers, the double-sided tape can be adhered on the first inner side surface 21 and the second inner side surface 41 by a machine, and then to be sold as a product thereof.

In some embodiments, referring to FIG. 3, an adhesive layer 10 having a tearable protective film is formed on the first inner side surface 21 and the second inner side surface 41. In FIG. 3, the adhesive layer 10 is not directly illustrated because the thickness of the adhesive layer 10 adhered to the first inner side surface 21 and the second inner side surface 41 is thin. In this way, the user's step of applying the double-sided tape can be effectively avoided, thereby improving the convenience of use. After the user purchasing, the protective film can be easily torn off, and then the first inner side surface 21 and the second inner side surface 41 are adhered to both sides of the corner, respectively, so that the intermediate portion 3 wraps the edge of the corner.

The adhesive layer 10 may be a double-sided tape, or may be another adhesive layer, for example, an adhesive layer may be painted on the first inner side surface 21 and the second inner side surface 41, and then a protective film may be attached to the adhesive layer.

In addition, in some embodiments, when the angle between the first inner side surface 21 and the second inner side surface 41 is 180°, the adhesive layer 10 (e.g. double-sided tape) can be automatically adhered to the first inner side surface 21 and the second inner side surface 41 by a machine, thereby ensuring the uniformity and consistency of the adhesive layer 10 on the first inner side surface 21 and the second inner side surface 41, which can improve the adhesion quality of the anti-collision strip and prevent the occurrence of adhesive failure or peeling.

Figure 6:
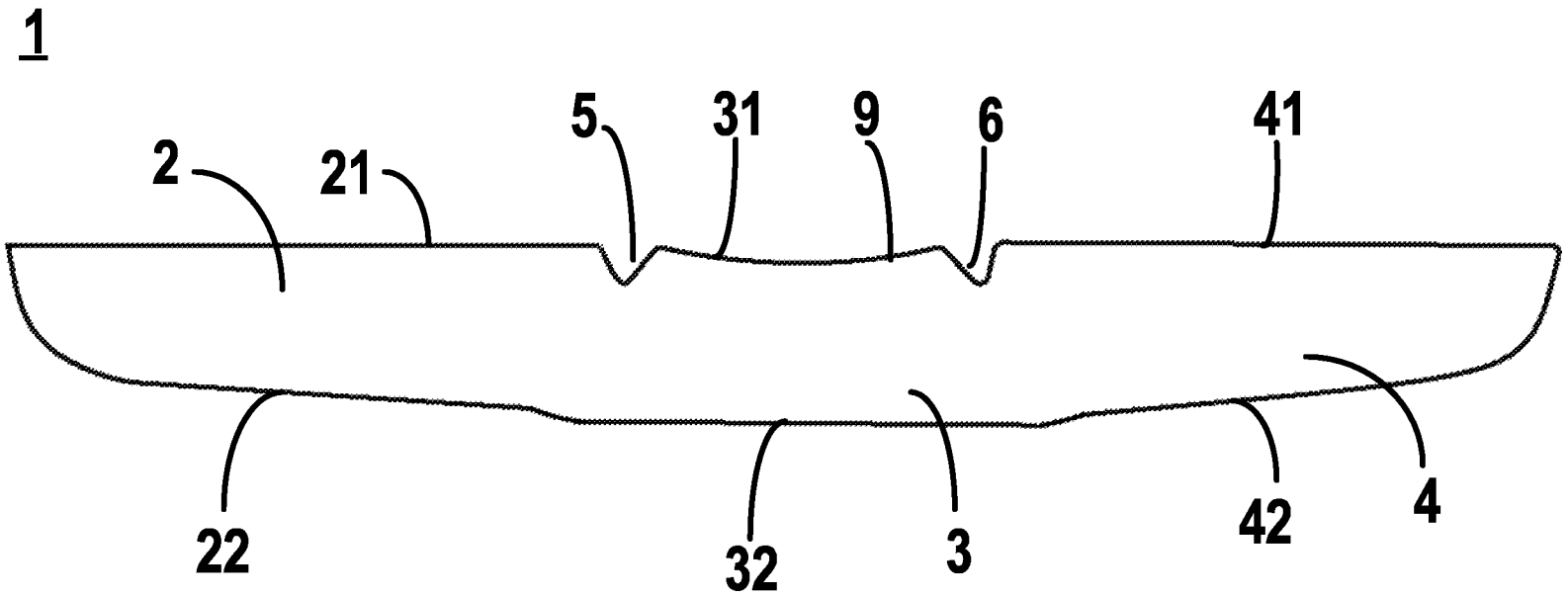
FIG. 6 is a schematic view of an end portion structure of yet another anti-collision strip provided by an embodiment of the present invention.

In addition, in some embodiments, the overall outer side surface of the anti-collision strip may be flush, for example, referring to FIG. 6, the first outer side surface 22 of the first side edge mounting portion 2 and the intermediate outer side surface 32 of the intermediate portion 3 may be flush connected, and the second outer side surface 42 of the second side edge mounting portion 4 and the intermediate outer side surface 32 of the intermediate portion 3 may be flush connected.

In addition, in some embodiments, referring to FIGS. 1, 2 and 3, the junction of the first outer side surface 22 of the first side edge mounting portion 2 and the intermediate outer side surface 32 of the intermediate portion 3 is formed with a first outer side groove 7 extending in the length direction of the anti-collision strip, and the junction of the second outer side surface 42 of the second side edge mounting portion 4 and the intermediate outer side surface 32 of the intermediate portion 3 is formed with a second outer side groove 8 extending in the length direction of the anti-collision strip. Thus, the first outer side groove 7 may form a partition space at the junction of the first outer side surface 22 and the intermediate outer side surface 32, and the second outer side groove 8 may form a partition space at the junction of the second outer side surface 42 and the intermediate outer side surface 32, which reduces the resilience of the anti-collision strip. When the anti-collision strip is in the mounted state, pulling at the junction of the first outer side surface 22 and the intermediate outer side surface 32 is avoided, and pulling at the junction of the second outer side surface 42 and the intermediate outer side surface 32 is avoided, thereby reducing or avoiding peeling of the anti-collision strip due to excessive resilience in the mounted state, particularly in the 90° mounted state.

In addition, in some embodiments, if the thickness of the anti-collision strip is thick, the first inner side groove 5 and the first outer side groove 7 may be aligned in the thickness direction of the anti-collision strip, and the second inner side groove 6 and the second outer side groove 8 may be aligned in the thickness direction of the anti-collision strip. In addition, in some embodiments, referring to FIGS. 2 and 3, the first inner side groove 5 and the first outer side groove 7 are staggered in the width direction of the anti-collision strip, and the second inner side groove 6 and the second outer side groove 8 are staggered in the width direction of the anti-collision strip, such that the distance between the first outer side groove 7 and the second outer side groove 8 is greater than the distance between the first inner side groove 5 and the second inner side groove 6. Thus, by this staggered arrangement, it is possible to reduce the thickness of the anti-collision strip to some extent, to reduce the resilience of the anti-collision strip, and to improve the adhesion stability of the anti-collision strip.

In addition, the distance between the groove bottom of the first inner side groove 5 and the groove bottom of the first outer side groove 7 in the thickness direction of the anti-collision strip may have any desired value, for example, in some embodiments, the distance between the groove bottom of the first inner side groove 5 and the groove bottom of the first outer side groove 7 in the thickness direction of the anti-collision strip is greater than 0.5 cm. In some embodiments, the distance between the groove bottom of the first inner side groove 5 and the groove bottom of the first outer side groove 7 in the thickness direction of the anti-collision strip may be 0.8-1.0 cm. Of course, the distance may also have other values less than 0.5 cm, for example 0.4 cm.

In addition, in the anti-collision strip 1 of the present invention, the first outer side groove 7 and the second outer side groove 8 may have any desired depth, that is, the distance from an opening portion to the bottom of the groove. For example, in some embodiments, the depth of the first outer side groove 7 and the second outer side groove 8 is 0.1 cm-0.3 cm. In some embodiments, the first outer side groove 7 and the second outer side groove 8 have a depth of 0.2 cm. Further, the first outer side groove 7 and the second outer side groove 8 may have the same depth or may have different depths.

Furthermore, in the anti-collision strip 1 of the present invention, the cross-sectional shapes of the first outer side groove 7 and the second outer side groove 8 may have any desired shapes, for example, in some embodiments, the cross-sectional shapes of the first outer side groove 7 and the second outer side groove 8 include a V-shape (e.g. the V-shape shown in FIGS. 2 and 3), a U-shape, or a semicircular shape. The V-shape. U-shape or semicircular shape not only facilitate processing, but also form an arc-shaped transition at the bottom of the groove, which avoids tearing the anti-collision strip at the first outer side groove 7 and the second outer side groove 8. Of course, the cross-sectional shapes of the first outer side groove 7 and the second outer side groove 8 are not limited thereto, and may be rectangular, trapezoidal, or other shapes.

In addition, in the anti-collision strip 1 of the present invention, the intermediate portion 3 may have a uniform thickness in the width direction or a variable thickness. Further, in some embodiments, the thickness of the intermediate portion 3 is the same as the thickness of the first side edge mounting portion 2 and the second side edge mounting portion 4. For example, the thickness of the intermediate portion 3 is the same as the thickness of inner side ends of the first side edge mounting portion 2 and the second side edge mounting portion 4 near the intermediate portion 3. In some embodiments, the thickness of the intermediate portion 3 is greater than the thickness of the first side edge mounting portion 2 and the second side edge mounting portion 4. In this way, the intermediate portion 3 provides a reliable and effective protection for the edge of the corner in the adhesive state, regardless how the intermediate portion 3 is tensioned in the width direction of the anti-collision strip. In other embodiments, the thickness of the intermediate portion 3 may also be less than the thickness of at least one of the first side edge mounting portion 2 and the second side edge mounting portion 4. However, as long as the required thickness of the intermediate portion 3 is ensured, the local thickness of the intermediate portion 3 may be prevented from being thin. For example, in some embodiments, the intermediate portion 3 is formed with a plurality of grooves arranged at intervals in the width direction of the anti-collision strip and extending along the length direction of the anti-collision strip, but the thickness of the intermediate portion 3 at the grooves also satisfies the desired thickness.

Additionally, in some embodiments, the intermediate inner side surface 31 may be planar. In some embodiments, referring to FIGS. 1, 2, and 3, the intermediate inner side surface 31 is a concave arc-shaped surface 9. Thus, the concave arc-shaped surface 9) can accommodate and be attached to the edge when the anti-collision strip 1 is adhered, and the resilience of the anti-collision strip can be reduced.

In addition, in some embodiments, in order to enhance the protective effect of the concave arc-shaped surface 9 on the edge, the thickness of the intermediate portion 3 at the lowest point of the concave arc-shaped surface 9 is greater than the thickness of the first side edge mounting portion 2 and the second side edge mounting portion 4, for example, greater than the thickness of the inner side ends of the first side edge mounting portion 2 and the second side edge mounting portion 4 near the intermediate portion 3.

In addition, in the anti-collision strip 1 of the present invention, the width distance between the two side edges of the intermediate inner side surface 31 in the width direction of the anti-collision strip may have any desired value. For example, in some embodiments, the width distance between the two side edges of the intermediate inner side surface 31 in the width direction of the anti-collision strip is between 0.6 cm and 1.2 cm. In some embodiments, the width distance between the two side edges of the intermediate inner side surface 31 in the width direction of the anti-collision strip is between 0.8 cm and 1.0 cm. In addition, the width distance may have other values outside the range of values, such as 0.5 cm, or 1.5 cm.

Furthermore, in the anti-collision strip 1 of the present invention, in a natural state of the anti-collision strip, the intermediate outer side surface 32 of the intermediate portion 3 is a flat surface or a convex arc-shaped surface. For example. FIGS. 2 and 3 show the intermediate outer side surface 32 being a flat surface. In the mounted state of the anti-collision strip 1, the outer side surface will be tensioned, so that this flat or convex arc-shaped surface ensures an effective protection for the edge by the intermediate part 3.

In addition, in some embodiments, the first side edge mounting portion 2 and the second side edge mounting portion 4 have a uniform thickness in the width direction of the anti-collision strip. In some embodiments, referring to FIGS. 2 and 3, the first outer side surface 22 of the first side edge mounting portion 2 is obliquely arranged so that the first side edge mounting portion 2 has a gradually decreased thickness, i.e. the first side edge mounting portion 2 gradually decreases, and the second outer side surface 42 of the second side edge mounting portion 4 is obliquely arranged so that the second side edge mounting portion 4 has a gradually decreased thickness, i.e. the thickness of the second side edge mounting portion 4 gradually decreases along a direction from the intermediate portion toward each side edge. In this way, the weight of the anti-collision strip 1 can be effectively reduced and the cost can be reduced while ensuring the protective effect of the intermediate portion 3 for the edge. In addition, the first outer side surface 22 and the second outer side surface 42 may be obliquely arranged flat, or may be obliquely arranged arcuately, or may be obliquely arranged flat and then obliquely arranged arcuately. Of course, the inclined arrangement of first outer side surface 22 and second outer side surface 42 is not limited to this.

In addition, in the anti-collision strip 1 of the present invention, the widths of the first inner side surface 21 and the second inner side surface 41 may be of any desired value. For example, in some embodiments, the width of the first inner side surface 21 and the second inner side surface 41 is between 2.5 cm and 3.5 cm. Such a width may meet the edge protection requirements of most locations. Additionally, in some embodiments, the width of the first inner side surface 21 and the second inner side surface 41 is between 2.8 cm and 3.0 cm. In addition, the width may have other values outside the range of values, such as 2.0 cm to 2.4 cm, or 3.6 cm to 3.8 cm.

Further, considering the different corner protection requirements, in some embodiments, at least one of the first side edge mounting portion 2 and the second side edge mounting portion 4 is formed with at least one cutting track (not shown in figures) extending along the length of the anti-collision strip, the cutting track is configured to allow a user to cut along the length of the anti-collision strip to reduce the width of the corresponding side edge mounting portion. In this way, if necessary, the user can adjust the width of at least one of the first side edge mounting part 2 and the second side edge mounting part 4 according to the width of the side of the corner, so that at least one of the first side edge mounting part 2 and the second side edge mounting part 4 is more adapted to the corresponding side, thereby enhancing the user's feeling of use.

In addition, the cutting trace may be an indicating mark or may be an indicating recess. In addition, the cutting trace may be formed on the outer side surface of at least one of the first side edge mounting portion 2 and the second side edge mounting portion 4, or may be formed on the outer side surface and the inner side surface of at least one of the first side edge mounting portion 2 and the second side edge mounting portion 4.

In addition, the anti-collision strip 1 of the present invention can be applied to any occasions, including but not limited to the anti-collision of children and old people in a home, and the anti-collision of any sharp face in industrial and commercial fields such as factories, warehouses, offices, schools, hospitals, nursing home, etc. In addition, the purpose of anti-collision is not limited to protecting people, but also pets, as well as preventing damage to the edges of walls, pillars, furniture, appliances, large-scale valuable goods for sale.

Furthermore, the anti-collision strip 1 of the present invention can be made of any suitable elastic or cushioning material, for example, including but not limited to rubber, PVC, TPR, NBR, etc.

In a second aspect, the present invention provides a bundle roll of anti-collision strip, wherein the bundle roll of anti-collision strip comprises at least one anti-collision strip of any one of the above first aspect, wherein at least one of the anti-collision strip is wound into a bundle roll with its inner side surface facing outwards. In this way, cutting of a long anti-collision strip into a plurality of shorter strip sections for packaging, storage and transport can be avoided. In addition, it is also convenient to naturally bundling the anti-collision strip to reduce storage space and to facilitate package transportation.

It will be understood by persons skilled in the art that the embodiments described above are illustrative and not restrictive. The different technical features that appear in different embodiments may be combined to achieve a beneficial effect. Other variations to the disclosed embodiments can be understood and effected by those skilled in the art on the basis of studying the drawings, description and claims. Any reference signs in the claims shall not be construed as limiting the scope. The fact that certain features are recited in mutually different dependent claims does not mean that these technical features cannot be combined to achieve a beneficial effect.

The invention claimed is:

1. An anti-collision strip comprising a first side edge mounting portion (2) configured to be adhered to a corner surface, an intermediate portion (3), and a second side edge mounting portion (4) connected in sequence along a width direction of the anti-collision strip (1) and configured to be adhered to the corner surface, the first side edge mounting portion (2), the intermediate portion (3) and the second side edge mounting portion (4) extending along a length direction of the anti-collision strip, wherein a first inner side groove (5) extending along the length direction of the anti-collision strip is formed at a junction of a first inner side surface (21) of the first side edge mounting portion (2) and an intermediate inner side surface (31) of the intermediate portion (3), a second inner side groove (6) extending along the length direction of the anti-collision strip is formed at a junction of a second inner side surface (41) of the second side edge mounting portion (4) and the intermediate inner side surface (31) of the intermediate portion (3).

2. The anti-collision strip of claim 1, wherein a first outer side groove (7) extending along the length direction of the anti-collision strip is formed at a junction of a first outer side surface (22) of the first side edge mounting portion (2) and an intermediate outer side surface (32) of the intermediate portion (3), a second outer side groove (8) extending along the length direction of the anti-collision strip is formed at a junction of a second outer side surface (42) of the second side edge mounting portion (4) and the intermediate outer side surface (32) of the intermediate portion (3).

3. The anti-collision strip of claim 2, wherein the first outer side groove (7) is located outside the first inner side groove (5) in the width direction of the anti-collision strip, and the second outer side groove (8) is located outside the second inner side groove (6) in the width direction of the anti-collision strip.

4. The anti-collision strip of claim 2, wherein in a natural state of the anti-collision strip, the intermediate outer side surface (32) of the intermediate portion (3) is a flat surface or a convex arc-shaped surface, along a direction from the intermediate portion (3) to each side edge, the first outer side surface (22) of the first side edge mounting portion (2) is obliquely arranged so that the first side edge mounting portion (2) has a gradually decreased thickness, and the second outer side surface (42) of the second side edge mounting portion (4) is obliquely arranged so that the second side edge mounting portion (4) has a gradually decreased thickness.

5. The anti-collision strip of claim 1, wherein the intermediate inner side surface (31) is a concave arc-shaped surface (9).

6. The anti-collision strip of claim 5, wherein a thickness of the intermediate portion (3) at a lowest point of the concave arc-shaped surface (9) is greater than a thickness of the first side edge mounting portion (2) and the second side edge mounting portion (4).

7. The anti-collision strip of claim 1, wherein in a natural state of the anti-collision strip, an angle (A) between the first inner side surface (21) and the second inner side surface (41) satisfies: $90° \leq \text{Angle (A)} \leq 180°$.

8. The anti-collision strip of claim 1, wherein an adhesive layer (10) with a tearable protective film is formed on the first inner side surface (21) and the second inner side surface (41).

9. The anti-collision strip of claim 1, wherein an outer side surface of at least one of the first side edge mounting portion (2) and the second side edge mounting portion (4) has at least one cutting track extending along the length direction of the anti-collision strip, the at least one cutting track being configured to allow a user to cut along the length direction of the anti-collision strip to reduce a width of a corresponding side edge mounting portion.

10. A bundle roll of anti-collision strip, wherein the bundle roll comprises at least one anti-collision strip of claim 1, wherein at least one of the anti-collision strip is wound into a bundle roll with its inner side surface facing outwards.

* * * * *